United States Patent [19]

Johnson et al.

[11] 4,446,397

[45] May 1, 1984

[54] HIGH INTENSITY DISCHARGE LAMP WITH INFRARED REFLECTING MEANS FOR IMPROVING EFFICACY

[75] Inventors: Peter D. Johnson; Seth D. Silverstein, both of Schenectady, N.Y.

[73] Assignee: General Electric Company, Schenectady, N.Y.

[21] Appl. No.: 305,820

[22] Filed: Sep. 28, 1981

[51] Int. Cl.[3] ..... H01J 61/35; H01J 61/40; H01J 61/52

[52] U.S. Cl. ..... 313/25; 313/47; 313/112; 313/113

[58] Field of Search ..... 313/113, 47, 25, 112, 313/114

[56] References Cited

U.S. PATENT DOCUMENTS

| | | | |
|---|---|---|---|
| 2,254,845 | 9/1941 | Gustin et al. | 313/47 |
| 2,799,791 | 7/1957 | Honing et al. | 313/113 X |
| 3,662,203 | 5/1972 | Kuhl et al. | 313/25 |
| 4,278,910 | 7/1981 | Keeffe et al. | 313/220 |

FOREIGN PATENT DOCUMENTS

| | | | |
|---|---|---|---|
| 2243663 | 3/1973 | Fed. Rep. of Germany | 313/114 |
| 31997 | 3/1962 | Finland | 313/114 |

*Primary Examiner*—Palmer C. Demeo

*Attorney, Agent, or Firm*—William H. Steinberg; James C. Davis, Jr.; Marvin Snyder

[57] ABSTRACT

A high intensity discharge lamp is provided with means for reflecting infrared radiation from the hot central portion of the arc tube onto the cooler end portions of the tube. The infrared reflective means may be provided by one or more infrared reflecting shields surrounding a portion of the arc tube or by an indentation in the outer glass envelope of the lamp.

3 Claims, 4 Drawing Figures

HIGH INTENSITY DISCHARGE LAMP WITH INFRARED REFLECTING MEANS FOR IMPROVING EFFICACY

BACKGROUND OF THE INVENTION

The present invention relates to high intensity discharge lamps and, more particularly, to infrared reflecting means for improving lamp efficacy.

Approximately one-half of the power supplied to a metal halide-mercury arc lamp is dissipated as infrared incandescence from the fused quartz arc tube. It is desirable to reduce this energy loss or to use it in a way to improve lamp efficacy. In the present invention, the efficacy is improved by employing infrared reflecting means to redirect the infrared radiation from the hot part of the arc tube to the cooler arc tube end portions.

Infrared reflecting films have been used to improve the efficacy of low pressure sodium lamps and have been suggested for use in high intensity discharge lamps (such as those considered herein) by providing an infrared reflecting film coat on the interior of the outer lamp envelope. Additionally, there are also numerous patents and proposed products based on the reflection of infrared radiation back on to the filament of an incandescent lamp. Such a lamp is described, for example in U.S. Pat. No. 4,275,327, issued June 23, 1981 to Peter Walsh. It is also well known that the efficacy of metal halide-mercury lamps increases as the temperature of the halide reservoir increases. See "Characteristics of Mercury Vapor-Metallic Iodide Arc Lamps" by G. H. Reiling in Vol. 54, page 532 (1964) of the Journal of the Optical Society of America. With higher metal halide vapor pressure, the spectrum of the metal whose halide is present becomes more intense and the less efficient mercury spectrum is suppressed. Halide reservoir temperature can be increased simply by increasing the power to the lamp. However, this results in raising the temperature of all parts of the arc tube. In particular, the hotter central regions of the arc tube may approach temperatures at which devitrification becomes a problem. Accordingly, it is seen that a simple increase of power to the lamp is not a solution to the problem of increasing efficacy by heating of the reservoir.

SUMMARY OF THE INVENTION

In accordance with a preferred embodiment of the present invention a high intensity discharge lamp comprises a gas-tight arc discharge tube with electrodes disposed at either end thereof and containing an ionizable medium. Additionally, the lamp comprises an outer gas-tight envelope surrounding the arc tube and metal wire means for supporting the arc tube within the envelope and supplying electric power to the electrodes. Lastly, the lamp of the present invention comprises a reflector for selectively directing infrared radiation onto the ends of the arc tube. Thus, infrared radiation from the hottest part of the arc tube is used to heat the cooler (reservoir) regions. Since no additional heat is directed to the central region, this results in a more uniform temperature distribution and higher average temperature which improves both color and efficacy.

In accordance with one embodiment of the present invention, the infrared reflecting means comprises a circular reflector surrounding the arc tube and having a V-shaped cross section. In accordance with a second embodiment of the present invention, separate infrared reflecting shields surround the ends of the arc tube. In a third embodiment of the present invention, the infrared reflecting means is formed by providing a circular indentation in the outer lamp envelope.

Accordingly, it is an object of the present invention to provide a high intensity discharge lamp having improved efficacy.

It is also an object of the present invention to provide a high intensity discharge lamp in which the arc tube operates at a relatively uniform temperature distribution.

It is a further object of the present invention to provide a high intensity discharge lamp having improved color characteristics.

DESCRIPTION OF THE FIGURES

The subject matter which is regarded as the invention is particularly pointed out and distinctly claimed in the concluding portion of the specification. The invention, however, both as to organization and method of practice, together with further objects and advantages thereof, may best be understood by reference to the following description taken in conjunction with the accompanying drawings in which:

DETAILED DESCRIPTION OF THE INVENTION

Figure 1:
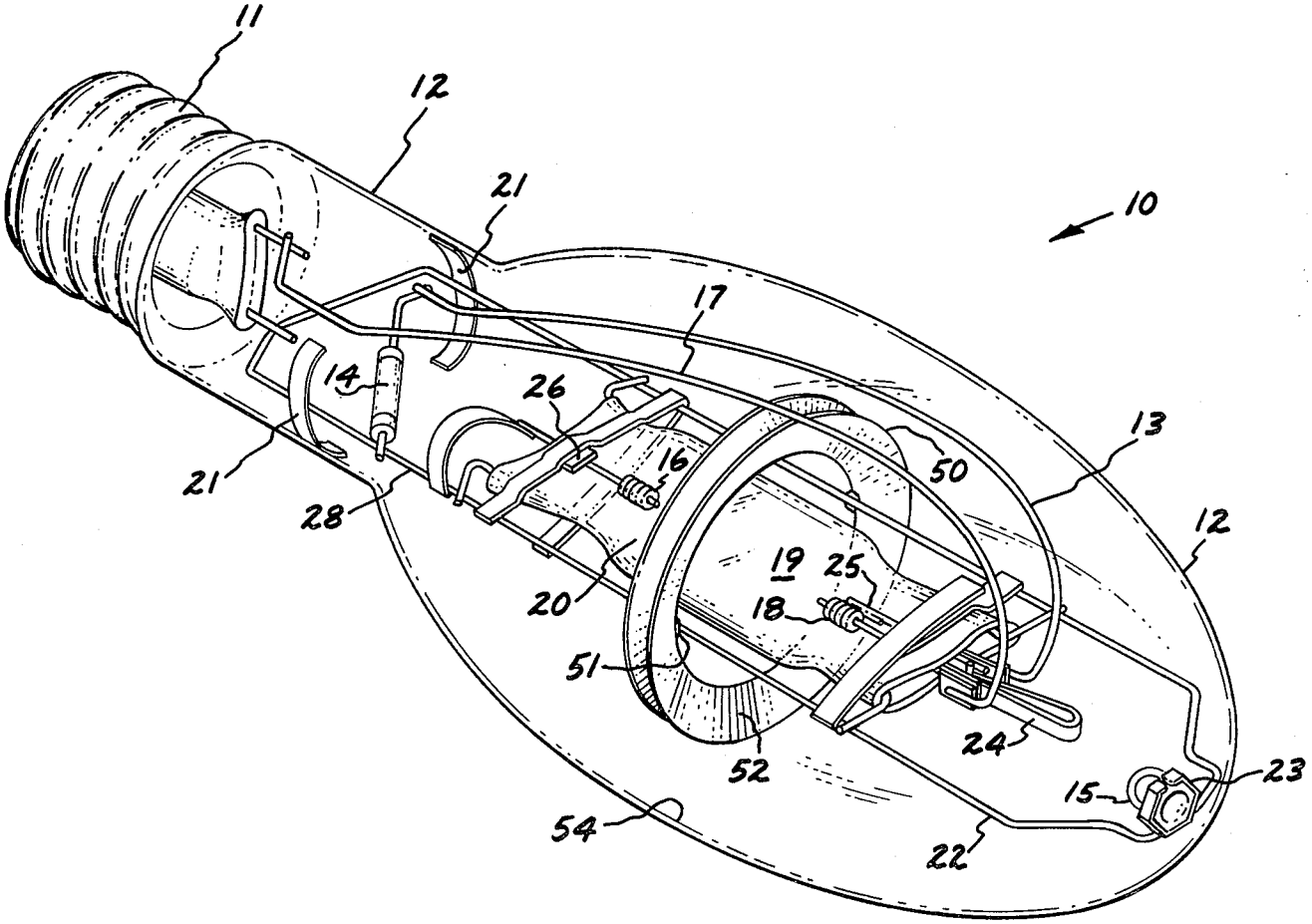
FIG. 1 is a detailed isometric view illustrating a high intensity discharge lamp employing one of the embodiments of the present invention.

FIG. 1 illustrates a conventional high intensity discharge lamp employing one embodiment of the present invention. Lamp 10 essentially comprises outer glass envelope 12 surrounding arc discharge tube 20. The arc discharge tube is preferably made of a light-transmissive material such as fused quartz and has electrodes 16 and 18 disposed at opposite ends thereof. The arc tube also preferably includes starting electrode 25 which is electrically connected to bimetallic strip 24. Strip 24 acts as a switch to apply a large potential between electrodes 25 and 18 during lamp starting, but thereafter acts to short out starting electrode 25. Additionally, the electrodes are preferably connected to the exterior of the arc tube by means of a flat molybdenum strip 26 which assists in providing a gas-tight seal for the arc tube. Arc discharge tube 20 also preferably contains ionizable medium 19 which may comprise, for example, at least one halide of a metal such as sodium, together with mercury.

The lamp also contains metal wire means for supporting the arc tube within the envelope and for supplying electric power to the electrodes. In particular, there is provided return lead 17 which is electrically connected to one side of the power source and to electrode 18. Lead 13 supplies power to the starting electrode, when necessary, through starting resistor 14. At the base of the lamp, lead framework 28 supports the arc discharge tube at the base end of the lamp. Spring strips 21, spot welded to lead frame 28, provide additional arc tube stability. At the tip end of the arc tube, (opposite the base end) lead framework 22 supports arc tube 20. In particular, framework 22 is spot welded to bent hexagonal loop 23 wich is fixed around dimple 15 provided in outer lamp envelope 12. Additionally, it is also conventional to provide envelope 12 with a base 11, such as the Edison-type base shown for facile connection to a power source. For clarity of presentation, many of the details present in FIG. 1 are shown only schematically in FIGS. 2, 3 and 4.

Lastly, and most importantly for the present invention, lamp 10 includes an infrared reflector for selectively directing infrared radiation on to the ends of the arc tube. In FIG. 1, this function is accomplished by reflector 50 having an infrared reflective coating 52 disposed on its inner surface. Reflector 50 preferably comprises a material, such as glass, which is transmissive of visible wavelength radiation but which is coated with an infrared reflecting material. In this way, infrared energy radiation from the central, hottest part of arc tube 20 is redirected to its relatively cooler end portions to provide additional heat to the metal halide-mercury reservoir which tends to form at the arc tube ends. The selective reflector 50 is mounted to framework 20 at points 51, as shown. In this embodiment of the present invention, outer envelope 12 may possess an interior infrared reflecting coating 54. Any suitable selectively infrared reflecting and visible transmitting coating may be used, such as doped semiconductors, $SnO_2$:F or $In_2O_3$:Sn or metals such as copper, silver or gold with or without antireflection dielectric coatings. This also applies to circular reflector 50.

Figure 2:
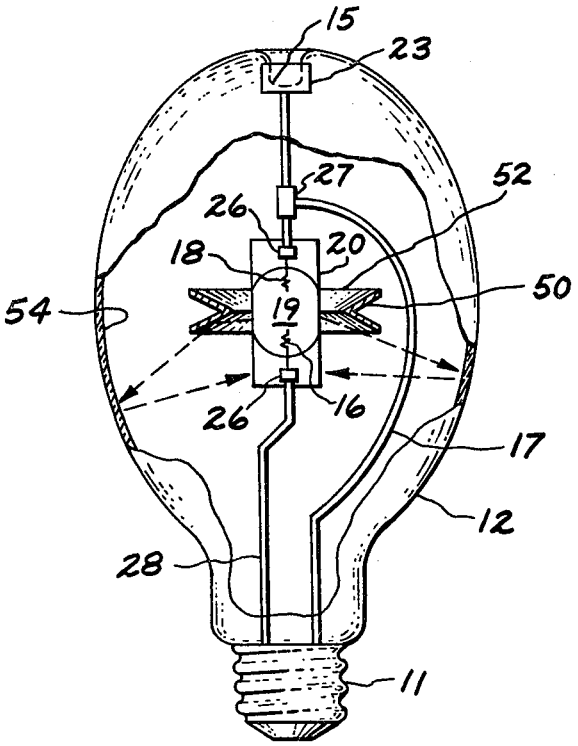
FIG. 2 is a partial cross-sectional side elevation and partially schematic diagram illustrating the same embodiment of the present invention as shown in FIG. 1.

FIG. 2 is a schematic diagram of the lamp 10 shown in FIG. 1. FIG. 2 provides a better understanding of the operation of the present invention. Since elements having the same reference numbers in FIGS. 1–4 are similarly made and configured, and since sufficient detail is shown in FIG. 1, mention hereafter is only made to the significant items of difference in FIGS. 2, 3 and 4. In particular, FIG. 2 shows reflector 50 in cross section. Here, it is shown as a circular reflector having a V-shaped cross section. However, those skilled in the art will appreciate that the reflector may be other than circular, for example, elliptical, and may also have a cross section that may be more U-shaped than is shown. Additionally, the infrared reflecting surface 52 on reflector 50 may be also be concave to focus the infrared radiated light directly onto the arc tube ends. The angle of the V in the reflector may be selected so that light is directly focussed onto the arc tube ends or, as shown, the V may be chosen to have a relatively shallow angle in which case radiated infrared light is first reflected from reflector 50 to the wall of outer envelope 12 and thence from reflective coating 54 on envelope 12 back onto the arc tube ends. Also the reflector may not comprise a fully closed loop but may instead comprise a partial arc especially if the reflector is not transmissive of visible radiation. Such an embodiment could look like the lamp of FIG. 2, except that reflector 50 could be shown without cross-sectional hatching.

Figure 3:
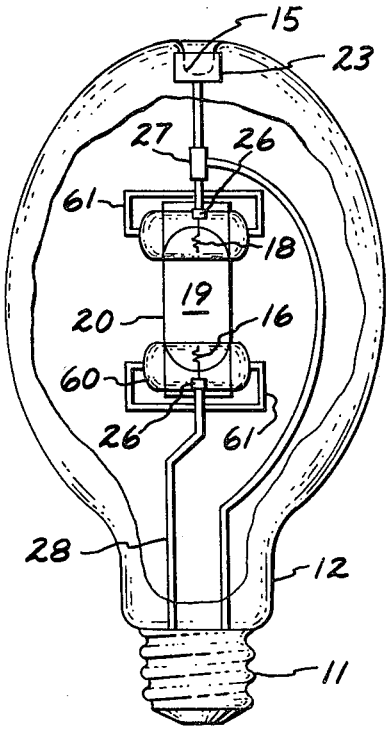
FIG. 3 is a partial cross-sectional schematic side elevation view of the embodiment of the present invention employing a pair of reflectors.
Figure 4:
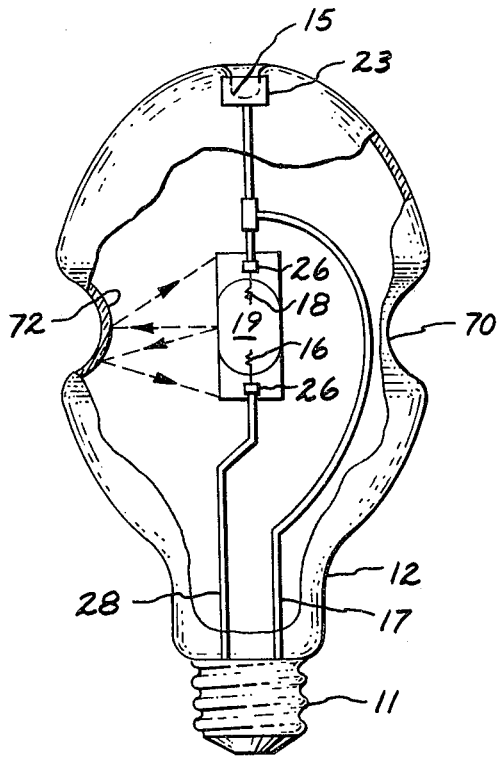
FIG. 4 is a partial cross-sectional schematic side elevation view illustrating an embodiment of the present invention employing an indented outer envelope.

FIG. 3 is an alternate embodiment of the present invention in which shields 60 are provided. These shields are affixed to wire support frame 61 and preferably comprise a material which is transmissive to visible light but reflective of infrared radiation. In the embodiment shown, the infrared radiation is reflected directly from the arc tube 20 back onto the arc tube ends for a more uniform distribution of arc tube temperature. The embodiment shown in FIG. 3 is particularly desirable for lamps employing relatively long arc tubes. Additionally, it is to be noted that shields 60 may also be at least partially closed so as to form reflective cups at either end of the arc tube. However, principally because of difficulty of manufacture this is not a preferred structure. However, the shields may exhibit an inward concavity, as shown, to better direct infrared radiation onto the arc tube ends. Alternatively, flatter cylindrical walls are also effective. Additionally, it is possible to use only a single shield rather than a pair, particularly if the lamp is to be operated in a vertical position, in which case, a lower shield is employed FIG. 4 illustrates yet another embodiment of the present invention in which a middle portion of outer envelope 12 possesses circular indentation 70. In this embodiment, the indented portion and preferably the remaining portion of outer envelope 12 possess an infrared reflective coating 72 such as those described above. The indentation serves to preferably reflect infrared radiation back onto the arc tube ends. This coating is also preferably visible light transmissive. As above, this provides more uniform arc tube temperatures. Since FIGS. 2, 3 and 4 are partially schematic, the full complexity of the metal wire structure supplying support and electric power to the arc tube is not shown. Instead, in these Figures, power supply lead 17 is shown welded to tie strip 27. However, one skilled in the lamp arts would appreciate that a separate frame for support and for supplying electric power may be provided. However, a common frame serving both purposes is eminently practical and generally employed.

From the above it is seen that the present invention operates to selectively increase the temperature of the arc tube end regions while maintaining a safe temperature in the central region. For the IR reflective coatings, the semiconductor oxides are preferred because of their ability to transmit visible light light. The size of the radiation shield reflectors depends upon the size and shape specific to the arc tube and the requirement of maintaining a shield reflector temperature not exceeding about 500 C. However, it should be noted that there is no requirement for precise alignment.

From the above, it may be appreciated that the present invention functions in a unique way to selectively provide reflected infrared radiation at the ends of the arc tube so as to maintain the arc tube at uniform temperatures. The structure of the present invention also permits the reservoir to be operated at a higher temperature than conventional lamps and thereby increases lamp efficacy by about 10% to 20%. Furthermore, because the uniformity of heating the color characteristics of high intensity discharge lamps employing the present invention are significantly improved.

While the invention has been described in detail herein in accord with certain preferred embodiments thereof, many modifications and changes therein may be effected by those skilled in the art. Accordingly, it is intended by the appended claims to cover all such modifications and changes as fall within the true spirit and scope of the invention.

The invention claimed is:

1. A high intensity discharge lamp comprising:

a gas-tight arc discharge tube having electrodes disposed at opposite ends thereof and containing an ionizable medium;

an outer gas-tight envelope surrounding said arc tube;

metal wire means for supporting said arc tube within said envelope and for supplying electric power to said electrodes; and an infrared radiation reflector transparent to visible light, having an arcuate section at least partially surrounding the central portion of the arc tube and having a generally V-shape cross section with the base of the V-shape portion directed toward the arc tube, said reflector arranged to reflect infrared radiation from the central portion of the arc tube onto the end portions of the arc tube.

2. The lamp of claim 1 in which said reflector comprises a closed loop.

3. A high intensity discharge lamp comprising:

a gas-tight arc discharge tube having electrodes disposed at opposite ends thereof and containing an ionizable medium;

an outer gas-tight envelope surrounding said arc tube said envelope having an indented portion surrounding the central portion of the arc tube, the interior surface of said indented portion having a convex shape with an infrared reflective coating thereon arranged to reflect infrared radiation from the central portion of the arc tube onto the end portion of the arc tube; and metal wire means for supporting said arc tube within said envelope and for supplying electric power to said electrodes.

* * * * *